US009138126B2

(12) United States Patent
Motabar et al.

(10) Patent No.: US 9,138,126 B2
(45) Date of Patent: Sep. 22, 2015

(54) HEIGHT ADJUSTABLE CONDUIT FOR A DISHWASHING APPLIANCE

(75) Inventors: Payam Motabar, Louisville, KY (US); Errin Gnadinger, Louisville, KY (US)

(73) Assignee: General Electric Company, Schenectady, NY (US)

( * ) Notice: Subject to any disclaimer, the term of this patent is extended or adjusted under 35 U.S.C. 154(b) by 925 days.

(21) Appl. No.: 13/287,457

(22) Filed: Nov. 2, 2011

(65) Prior Publication Data

US 2013/0104944 A1 May 2, 2013

(51) Int. Cl.
*A47L 15/50* (2006.01)

(52) U.S. Cl.
CPC ..... *A47L 15/508* (2013.01)

(58) Field of Classification Search
CPC ..... A47L 15/508; A47L 15/504; B08B 3/02
USPC ..... 134/152, 137; 211/70, 90.02, 98, 101, 211/102, 103, 111, 115, 166, 173, 174, 207
See application file for complete search history.

(56) References Cited

U.S. PATENT DOCUMENTS

| | | | | |
|---|---|---|---|---|
| 4,064,887 | A * | 12/1977 | Geiger et al. | 134/144 |
| 7,055,537 | B2 * | 6/2006 | Elick et al. | 134/180 |
| 2002/0129861 | A1 * | 9/2002 | Holdenried | 138/109 |
| 2007/0215187 | A1 * | 9/2007 | Koch et al. | 134/56 D |

FOREIGN PATENT DOCUMENTS

EP 0372342 B1 10/1993

* cited by examiner

*Primary Examiner* — Michael Barr
*Assistant Examiner* — Rita Adhlakha
(74) *Attorney, Agent, or Firm* — Dority & Manning, P.A.

(57) ABSTRACT

A conduit for a dishwashing appliance that is height adjustable and can accommodate different vertical positions of a rack assembly. One end of the conduit moves up and down with the rack assembly while maintaining a connection with e.g., a spray arm assembly suspended from the bottom of the rack assembly. The other end of the conduit remains in a relatively fixed vertical position during height adjustments so as to enable connection and reconnection at the fixed position of a main fluid supply conduit.

10 Claims, 7 Drawing Sheets

FIG. –1–

HEIGHT ADJUSTABLE CONDUIT FOR A DISHWASHING APPLIANCE

FIELD OF THE INVENTION

The subject matter of the present invention relates to a conduit for a dishwashing appliance that is height adjustable to allow for different vertical positions of a rack assembly.

BACKGROUND OF THE INVENTION

Modern dishwashers typically include a wash chamber where e.g., detergent, water, and heat can be applied to clean food or other materials from dishes and other articles being washed. Often an upper rack assembly is disposed close to the top of the washing chamber and is used to hold glasses, cups, and other small items. Typically, a lower rack assembly is positioned near the bottom of the chamber and a certain distance below the upper rack. This provides vertical clearance to place articles such as dishes and platters on edge (i.e. a vertical orientation) and to place food preparation bowls and pots up-side-down on the lower rack for washing.

Each rack normally is supplied with an array of spaced apart, generally vertical tines or members, which support and separate the individual items. Preferably, these vertical members support and fix the position of various articles during the washing process. More specifically, it is desirable to position an article, such as a dish, so that water and detergent can access all surfaces during cleaning while also preventing movement of the dish that could lead to breaking, chipping, or other damage.

Conventionally, water containing detergent, rinse water, and/or other fluids are sprayed onto the dishes by rotating spray arms positioned proximate to the racks. Such fluid is fed to the spray arms from a main supply conduit located at the rear of the dishwasher. During operation, the flow of water exiting the arms also provides for the rotation of the arms.

Typically, the mid-level spray arm assembly is attached to the bottom of the upper rack and provides for a spray of fluid to articles in both the upper and lower rack assemblies. In order to facilitate the loading and unloading of articles for cleaning, the upper rack can be mounted on wheels or otherwise provided with features that allow the upper rack to be readily moved in and out of the dishwasher. Such movement, however, creates challenges for consistently supplying fluid to the mid-level spray arm assembly.

More specifically, the mid-level spray arm assembly usually includes a conduit that is connected to the main supply conduit positioned at the rear of the dishwasher. As such, this conduit must be repeatedly connected and disconnected from the main supply as the upper rack assembly is moved in and out of the dishwashing appliance. If this connection is not properly established each time the upper rack assembly is pushed back into the appliance, fluid will not be supplied to operate the spray arm assembly and incomplete and/or inefficient cleaning of the articles in the appliance may occur.

In addition, in order to provide flexibility in accommodating articles of different sizes into the upper and lower rack assemblies, frequently the upper rack assembly may be height adjustable. For example, the upper rack can be lowered to allow larger items in the upper rack or raised to allow larger items in the lower rack. Such changes in the vertical position of the upper rack further complicates the task of consistently reconnecting the conduit of the mid-level spray arm assembly with the main fluid supply conduit located at the rear of the appliance.

Accordingly, a conduit for connecting a spray arm assembly with the main fluid supply in a dishwashing appliance would be useful. More particularly, a conduit that can allow for adjustments to the height of a rack assembly while providing for repeated connection and disconnection with the main fluid supply conduit would be beneficial. Such a conduit that can be readily adapted to existing designs for the rack assemblies of dishwashing appliances would also be particularly useful.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides a dishwasher rack assembly that includes a plurality of elongated members defining a front wall, a rear wall, a pair of opposing side walls, and a bottom wall. A pair of sliding members are mounted in an opposing manner—one on each of the side walls. Each sliding member defines at least one groove into which a vertical, elongated member is slidably received. A pair of arms are located near the rear wall. Each of the arms has one end connected to one of the sliding members and another end forming an opening. A fluid conduit is received into the opening formed by the pair of arms and is attached to the bottom wall.

In another exemplary embodiment, the present invention provides a dishwasher having a wash chamber for the receipt of articles for cleaning The dishwasher defines vertical and horizontal directions. The dishwasher includes a dishwasher rack assembly movably received into the wash chamber. The dishwasher rack assembly includes a plurality of elongated members defining a front wall, a rear wall, a pair of opposing side walls, and a bottom wall. A pair of wheel racks are positioned on the opposing side walls of the rack assembly. Each of the wheel racks has at least one wheel for movement of the rack assembly in and out of the dishwasher. Each of the wheel racks defines at least one groove into which a vertically-oriented, elongated member is slidably received. A conduit is suspended from the bottom wall of the rack assembly and extends along the horizontal direction towards the rear wall. A support member is positioned near the rear wall of the rack assembly. The support member defines an opening into which one end of the conduit is rotatably received.

In still another exemplary embodiment, the present invention provides a dishwasher rack assembly that includes a basket having a front portion, a rear portion, a bottom portion, and a pair of opposing side portions. The basket includes a plurality of elongated members. A pair of sliding members is attached to the opposing portions of the basket and are configured for sliding movement along a vertical direction of the rack assembly. A support member is attached to the sliding members. The support member has a pair of arms extending away from the opposing side portions and towards a center of the basket. A conduit is provided having a first end rotatably connected to the support member. The conduit is attached to the bottom portion of the basket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
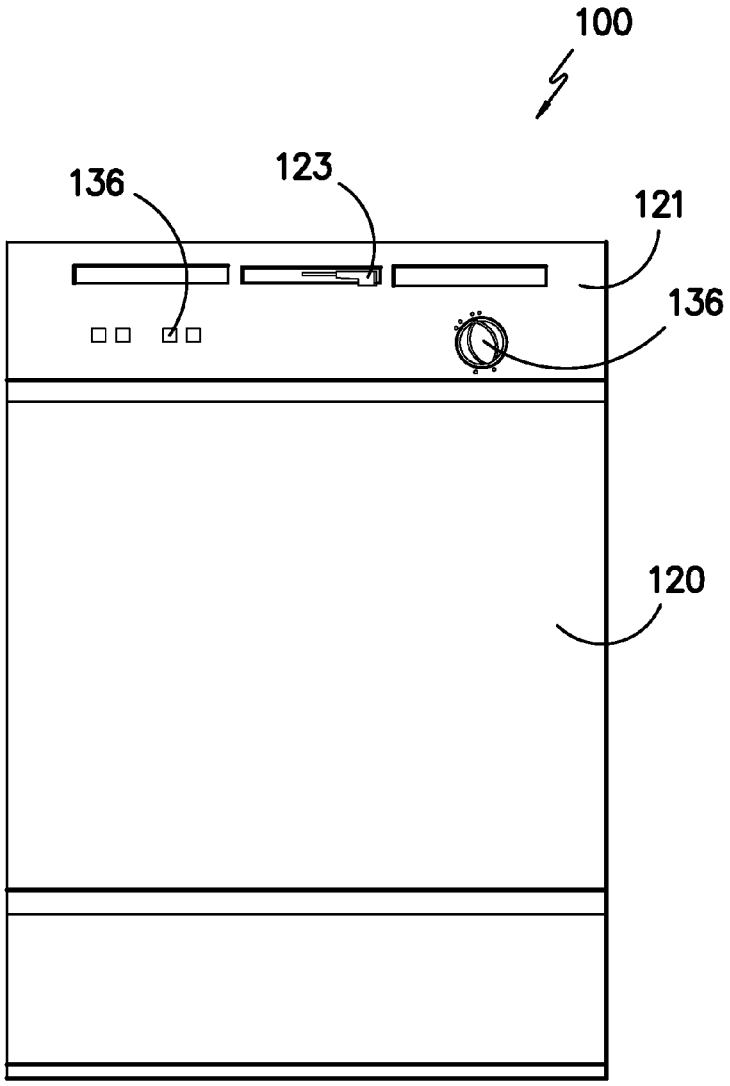
FIG. 1 provides a front, perspective view of an exemplary dishwashing appliance of the present invention.

The present invention relates to a conduit for a dishwashing appliance that is height adjustable to accommodate different vertical positions of a rack assembly. One end of the conduit moves up and down with the rack assembly while maintaining a connection with e.g., a spray arm assembly suspended from the bottom of the rack assembly. The other end of the conduit remains in a relatively fixed vertical position during height adjustments so as to enable connection and reconnection at the fixed position of a main fluid supply conduit.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
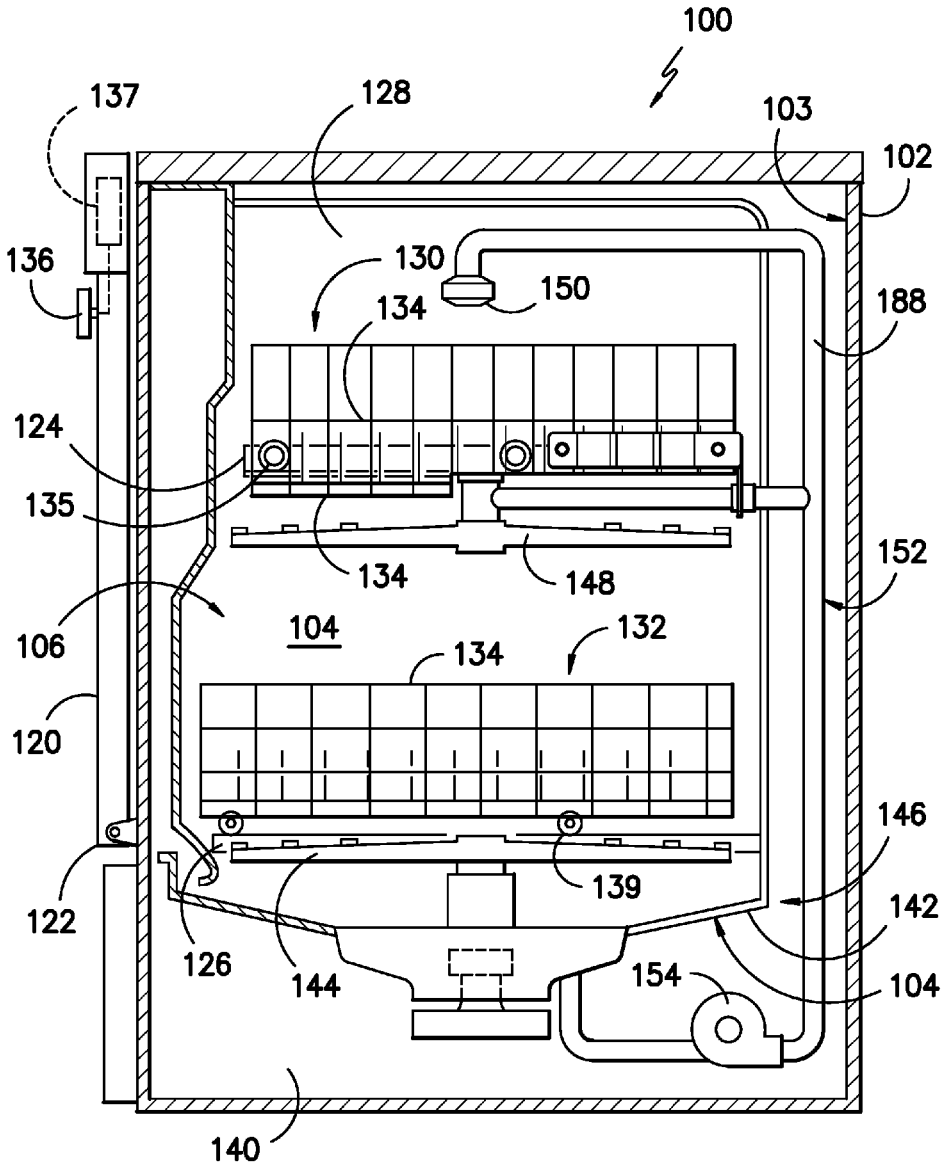
FIG. 2 provides a side, cross-sectional view of the exemplary embodiment of FIG. 1.

FIGS. 1 and 2 depict an exemplary domestic dishwasher 100 that may be configured in accordance with aspects of the present disclosure. For the particular embodiment of FIG. 1, the dishwasher 100 includes a cabinet 102 having a tub 104 therein that defines a wash chamber 106. The tub 104 includes a front opening (not shown) and a door 120 hinged at its bottom 122 for movement between a normally closed, vertical position (shown in FIGS. 1 and 2), wherein the wash chamber 106 is sealed shut for washing operation, and a horizontal, open position for loading and unloading of articles from the dishwasher. Latch 123 is used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

The lower and mid-level spray-arm assemblies 144, 148 and the upper spray assembly 150 are fed by a fluid circulation assembly 152 for circulating water and dishwasher fluid in the tub 104. The fluid circulation assembly 152 may include a pump 154 located in a machinery compartment 140 located below the bottom sump portion 142 of the tub 104, as generally recognized in the art. Each spray-arm assembly 144, 148 includes an arrangement of discharge ports or orifices for directing washing liquid onto dishes or other articles located in rack assemblies 130 and 132. The arrangement of the discharge ports in spray-arm assemblies 144, 148 provides a rotational force by virtue of washing fluid flowing through the discharge ports. The resultant rotation of the lower spray-arm assembly 144 provides coverage of dishes and other dishwasher contents with a washing spray. Fluid is supplied to mid-level spray arm assembly 148 by a main fluid supply conduit 188 that is connected to conduit 198 at rear wall 103.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electromechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher, and that the embodiment depicted in FIGS. 1 and 2 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles. Other configurations may be used as well.

Figure 3:
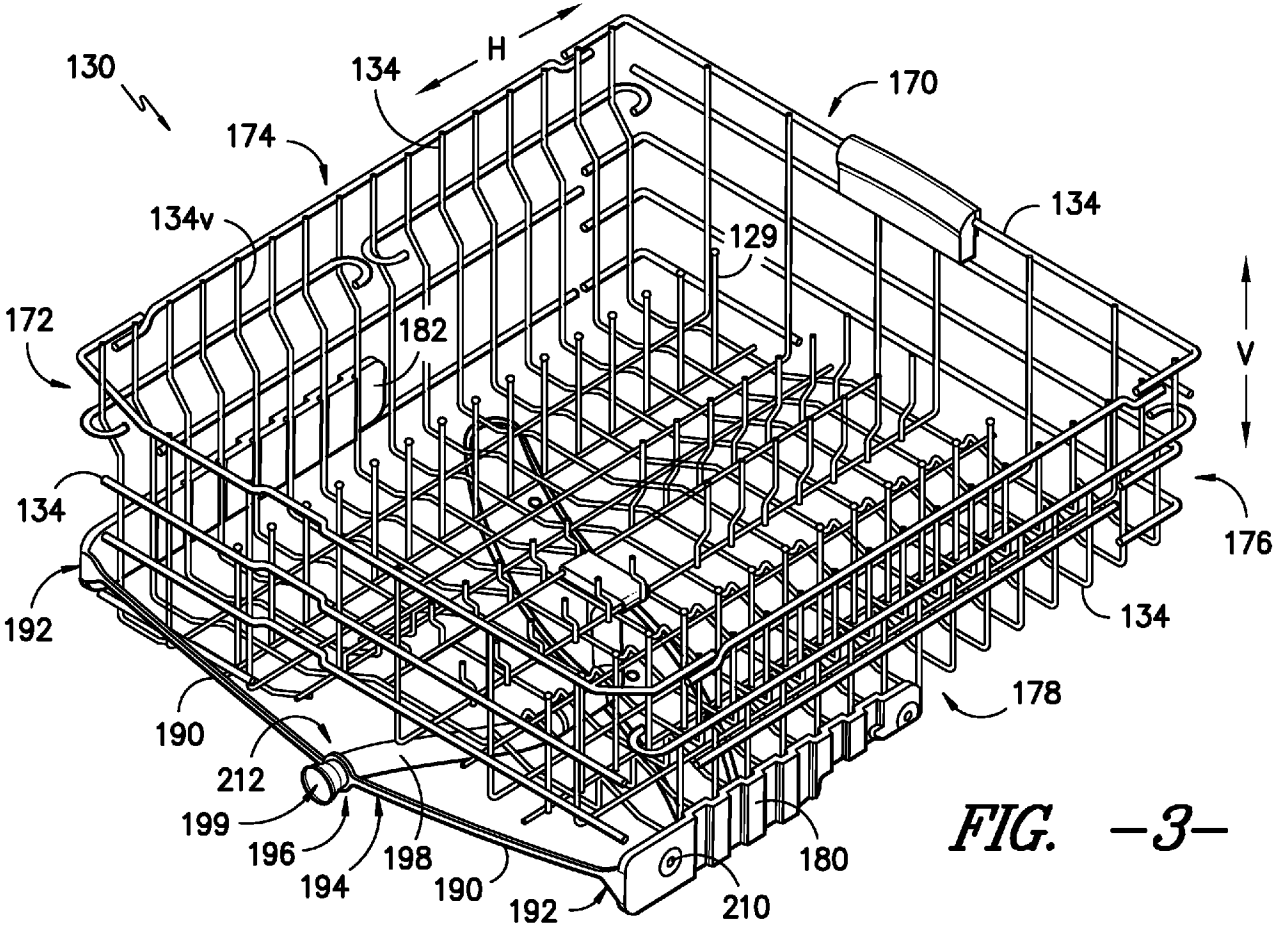
FIG. 3 is a perspective view of the top of an exemplary embodiment of an upper rack assembly as may be used with the present invention.

FIG. 3 provides a perspective view of the top of a rack assembly 130 showing more details for elongated members 134 than is illustrated in FIG. 2. More specifically, rack assembly 130 includes a plurality of elongated members 134 that define a front wall (or portion) 170, a rear wall 172, a pair of opposing side walls 174 and 176, and a bottom wall 178. A plurality of vertical tines extending from bottom wall 178 and can provide e.g., for the support of articles such as cups for cleaning. Rack assembly 130 is provided by way of example only; other constructions may be used with the present invention as well.

Figure 4:
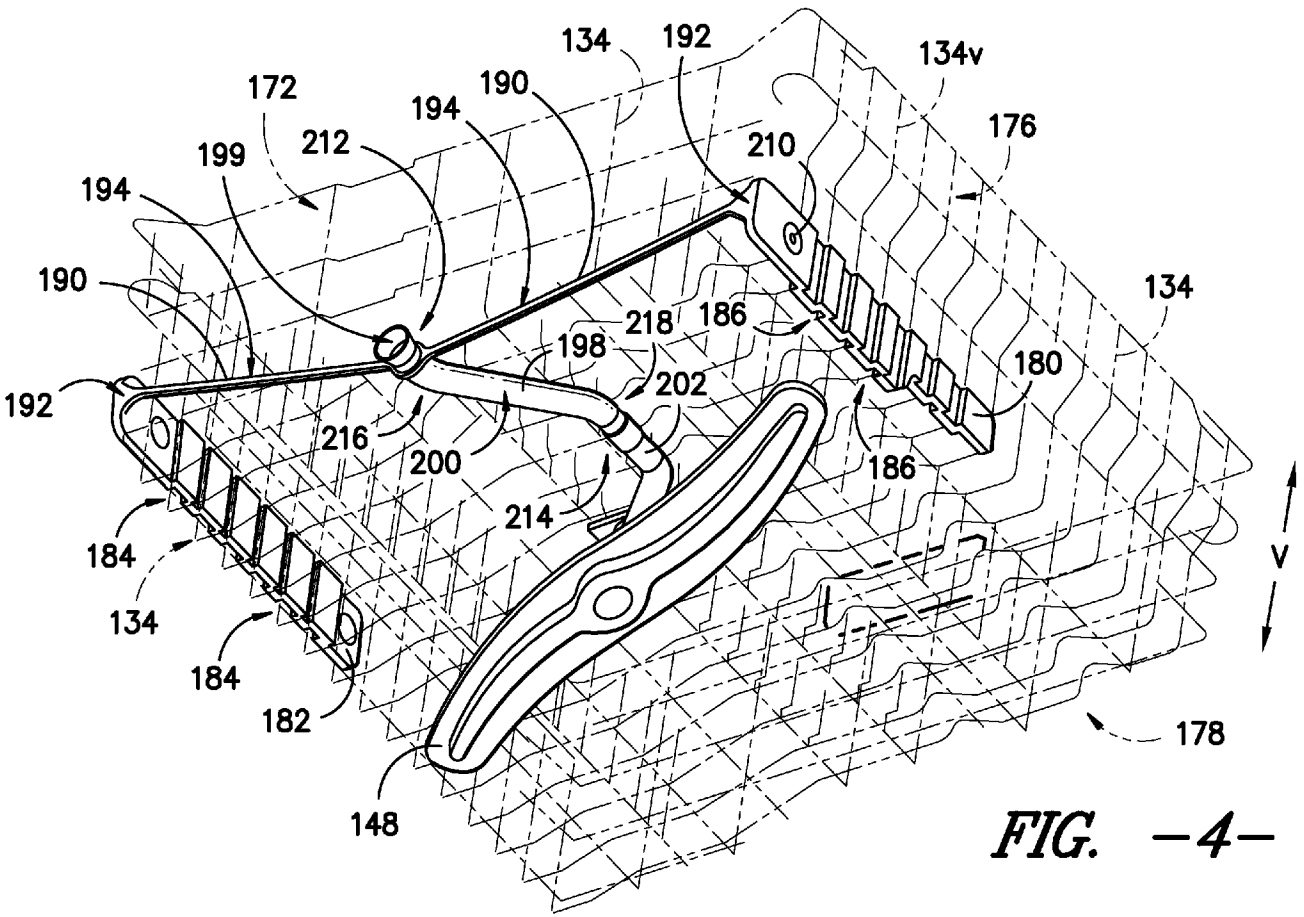
FIG. 4 is a perspective view of the bottom of an exemplary embodiment of an upper rack assembly as may be used with the present invention.

FIG. 4 is a perspective view of the bottom of rack assembly 130. For the sake of clarity in illustrating certain exemplary features of the present invention, elongated members 134 are shown in phantom lines. Referring now to both FIGS. 3 and 4, upper rack assembly 130 includes a pair of sliding members or wheel racks 180 and 182. Wheel rack 180 is mounted on side wall 176 while wheel rack 182 is mounted in an opposing manner on side wall 174.

Wheel rack 180 includes a plurality of vertically-oriented grooves 186 while wheel rack 182 includes a plurality of vertically-oriented grooves 184. More particularly, grooves 184 and 186 extend along vertical direction V as shown. Grooves 184 and 186 each contain a vertically-oriented tine member 134*v*, which is slidably received. Accordingly, upper rack assembly 130 can move up and down along the vertical direction V relative to wheel racks 180 and 182 as vertical tine members 134*v* slide along grooves 184 and 186.

Rack assembly 130 also includes a support member constructed as a pair of arms 190 that are located near rear wall 172. Each of the arms 190 has an end 192 connected to wheel rack 180. Together, the other end 194 of each arm 190 forms an opening 196 into which a fluid conduit 198 is rotatably received. More particularly, as rack assembly 130 is adjusted up or down by the sliding movement of racks 180 and 182 along vertical tines 134*v*, conduit 198 rotates freely within opening 196.

Figure 5:
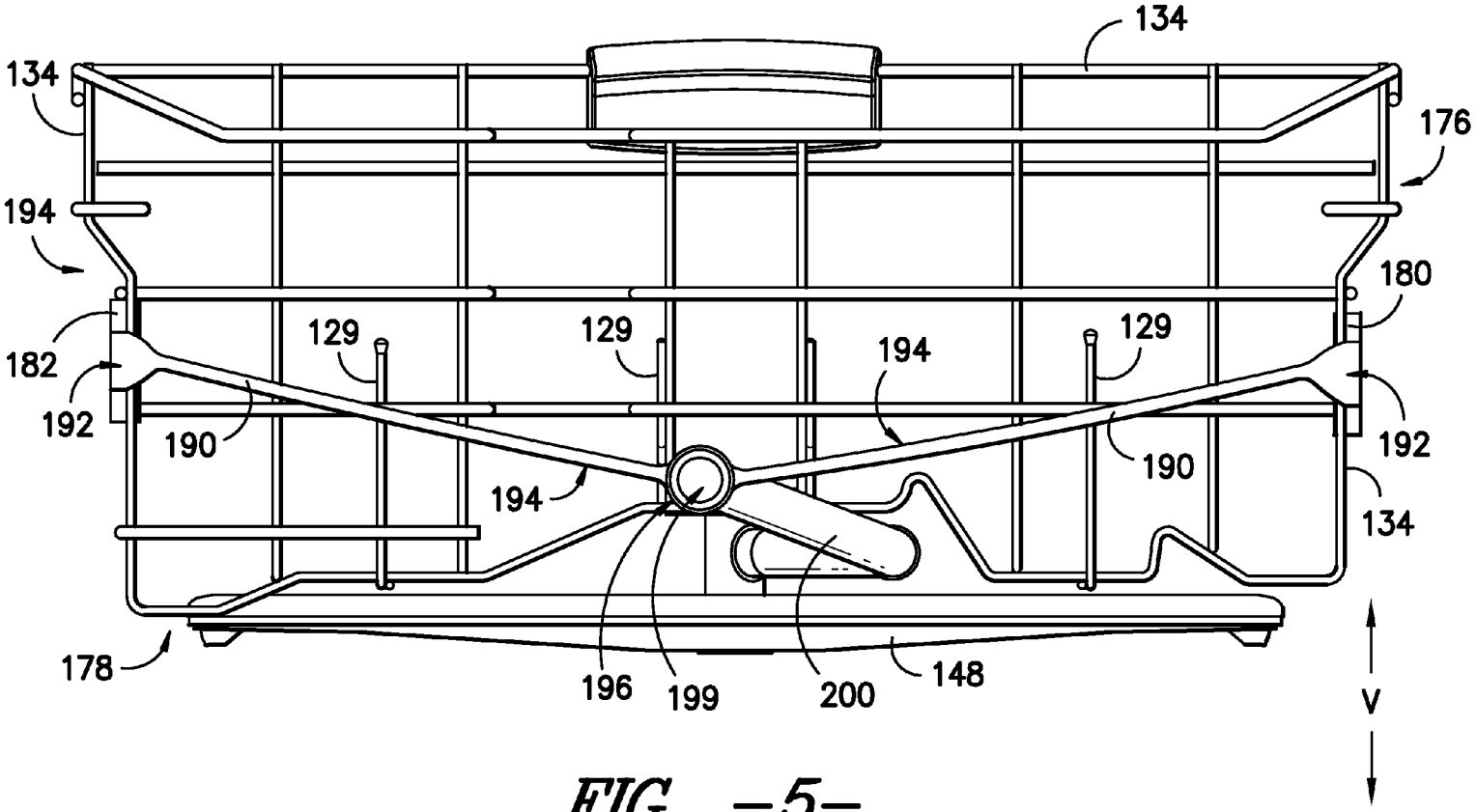
FIG. 5 is an end view of an exemplary embodiment of an upper rack assembly with the conduit shown in an upward position.
Figure 6:
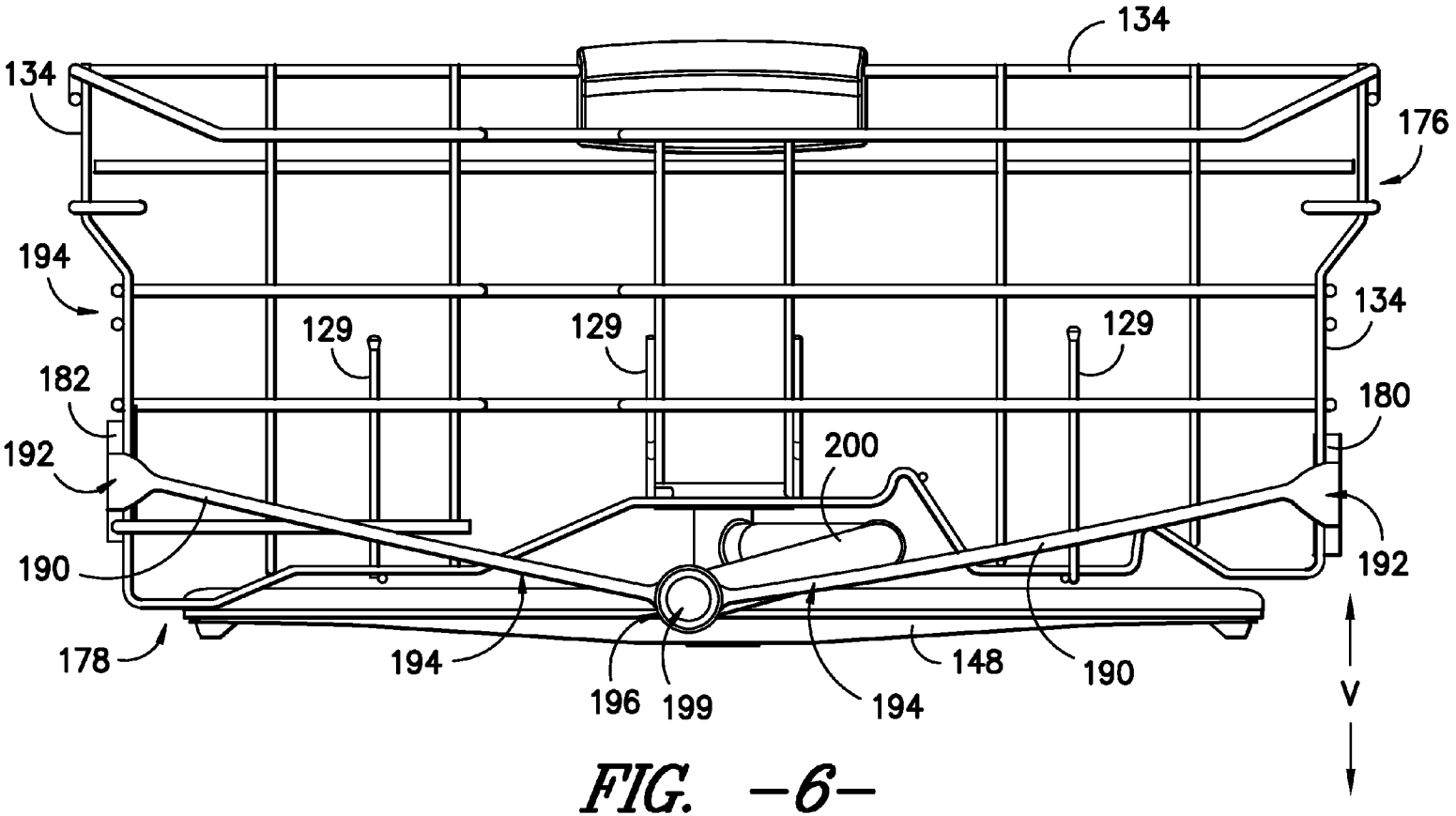
FIG. 6 is another end view of an exemplary embodiment of an upper rack assembly with the conduit shown in a lowered position.

Referring now to FIGS. 5 and 6, a comparison of these two figures shows the movement of conduit 198 relative to rack assembly 130. FIG. 5 shows the position of the opening 199 of conduit 198 and wheel racks 180 and 182 when rack assembly 130 is in a lowered position. FIG. 6 shows the position of opening 199 as and racks 180 and 192 when rack assembly 130 is in a raised position.

Figure 7:
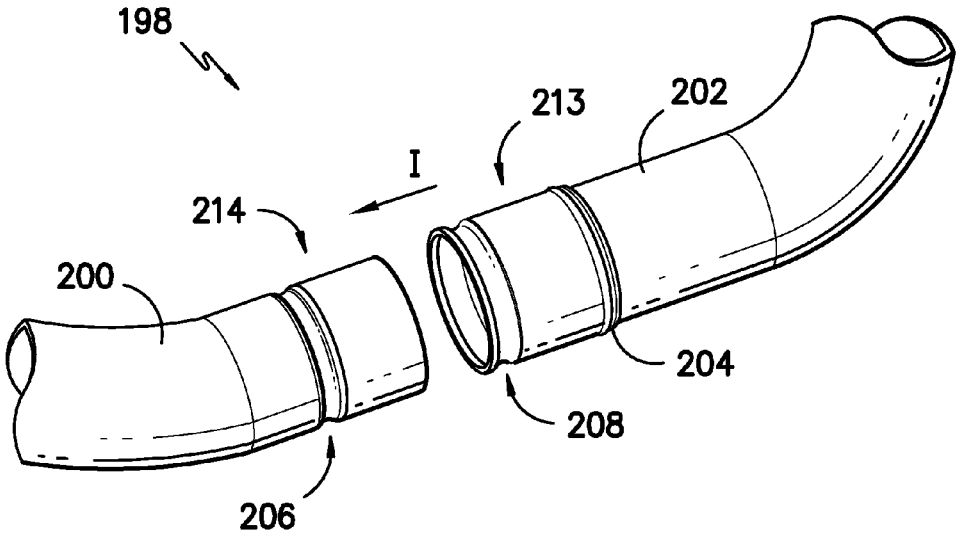
FIG. 7 is a partial perspective view of the connecting ends of the front and rear section of an exemplary conduit of the present invention.

As shown in FIGS. 4 and 7, fluid conduit 198 includes a rear section 200 and a front section 202. To allow movement of rack assembly 130 while maintaining a fixed height for the opening 199, rear section 200 is rotatable relative to front section 202. More particularly, first end 212 of rear section 200 rotates within opening 196 while second end 214 is allowed to rotate relative to front section 202.

As shown in FIG. 7, the second end 214 of rear section 200 is configured for receipt of an end 213 of front section 202. Second end 214 has an inside diameter that is slightly larger than the outside diameter of the end 213 of front section 202 and is configured for mating receipt thereof. A boss 206 on rear section 200 is configured for positioning into a recess or indentation 208 on front section 202 to lock the two sections together while still allowing rotation. O-ring 204 acts to provide a seal to prevent or minimize the escape of fluid from conduit 198. Other connections for providing a fluid tight seal between sections 200 and 202 may also be used provided the relative rotation of such sections is allowed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher rack assembly, comprising:

a plurality of elongated members defining a front wall, a rear wall, a pair of opposing side walls, and a bottom wall;

a pair of sliding members, each mounted in an opposing manner on one of said side walls, each said sliding member defining at least one groove into which a vertical, elongated member is slidably received;

a pair of arms located near said rear wall, each of said arms having one end connected to one of said sliding members and another end forming a fixed height opening; and a rigid fluid conduit received into the fixed height opening formed by said pair of arms and attached to said bottom wall, wherein said rigid fluid conduit further comprises;

a rear section received along a first end into the fixed height opening formed by said pair Of arms;

a front section attached to said bottom wall and inserted into a second end of said rear section, and;

wherein said front section is rotatable relative to said rear section and said front section moves up and down with the rack assembly as it is raised or lowered in the dishwasher, and wherein said first end of the rear section remains at the fixed height opening.

2. A dishwasher rack assembly as in claim 1, further comprising a spray arm assembly suspended below said bottom wall and connected to said fluid conduit for the receipt of fluid.

3. A dishwasher rack assembly as in claim 1, further comprising wheels positioned on said sliding members and configured for allowing the dishwasher rack assembly to be slid in or out of a dishwasher.

4. A dishwasher rack assembly as in claim 1, wherein said rear section comprises at least two angles between the first end and the second end.

5. A dishwasher rack assembly as in claim 1, further comprising a plurality of tines extending from said bottom wall and configured for the receipt of articles for cleaning.

6. A dishwasher having a wash chamber for the receipt of articles for leaning, the dishwasher defining vertical and horizontal directions, the dishwasher comprising:

a dishwasher rack assembly movably received into the wash chamber, the dishwasher rack assembly comprising a plurality of elongated members defining a front wall, a rear wall, a pair of opposing side walls, and a bottom wall;

a pair of wheel racks positioned on the opposing side walls of said rack assembly, each of said wheel racks having at least one wheel for movement of said rack assembly in and out of the dishwasher, each of said wheel racks defining at least one groove into which a vertically-oriented, elongated member is slidably received;

a rigid fluid conduit suspended from the bottom wall of said rack assembly and extending along the horizontal direction towards the rear wall;

a support member positioned near the rear wall of said rack assembly, said support member defining a fixed height opening into which one end of said rigid fluid conduit is rotatably received;

wherein said rigid fluid conduit further comprises;

a rear section received along a first end into the fixed height opening formed by said support member;

a front section attached to said bottom wall and inserted into second end of said rear section, and;

wherein said front section is rotatable relative to said rear section and said front section moves up and down with the rack assembly as it is raised or lowered in the dishwasher, and wherein said first end of the rear section remains at the fixed height opening.

7. A dishwasher as in claim 6, wherein said support member is connected to said wheel racks.

8. A dishwasher as in claim 7, further comprising a spray arm assembly attached to the bottom wall of said rack assembly, said spray arm assembly connected with said conduit for the receipt of fluid.

9. A dishwasher as in claim 6, wherein said rear section comprises at least two angles along its length.

10. A dishwasher as in claim 6, further comprising a main fluid supply conduit located along a rear wall of the dishwasher, and wherein said fluid conduit is releasably connected at said back section to said main fluid supply conduit.

* * * * *